US008870593B2

(12) United States Patent
Cheng

(10) Patent No.: US 8,870,593 B2
(45) Date of Patent: Oct. 28, 2014

(54) CAMERA SOCKET CONNECTOR

(75) Inventor: Xing-Jun Cheng, Shanghai (CN)

(73) Assignee: Molex Incorporated, Lisle, IL (US)

( * ) Notice: Subject to any disclaimer, the term of this patent is extended or adjusted under 35 U.S.C. 154(b) by 559 days.

(21) Appl. No.: 13/173,683

(22) Filed: Jun. 30, 2011

(65) Prior Publication Data

US 2012/0028501 A1 Feb. 2, 2012

(30) Foreign Application Priority Data

Jun. 30, 2010 (CN) ..... 2010 1 0218751

(51) Int. Cl.
*H01R 9/05* (2006.01)
*H01R 13/6594* (2011.01)

(52) U.S. Cl.
CPC ..... *H01R 13/6594* (2013.01)
USPC ..... 439/580

(58) Field of Classification Search
CPC ..... H01R 13/6594; H01R 13/658; H01R 13/6658; H01R 43/24
USPC ..... 439/580, 607.58, 626, 607.01, 70, 439/607.05, 330, 331, 607.27, 607.1, 108, 439/496
See application file for complete search history.

(56) References Cited

U.S. PATENT DOCUMENTS

| | | | | |
|---|---|---|---|---|
| 7,147,481 | B2 * | 12/2006 | Yang | 439/71 |
| 7,744,413 | B2 * | 6/2010 | Ma | 439/607.01 |
| 2008/0014797 | A1 * | 1/2008 | Yang | 439/607 |
| 2009/0035992 | A1 * | 2/2009 | Wu | 439/607 |

* cited by examiner

*Primary Examiner* — Edwin A. Leon
(74) *Attorney, Agent, or Firm* — Stephen L. Sheldon

(57) ABSTRACT

An electrical connector suitable for correspondingly housing an electronic module, the electrical connector having an insulation body, a plurality of conductive terminals installed on the insulation body, and a shielding housing, wherein the insulation body is a square frame enclosed by four side walls, and the shielding housing is installed beneath the insulation body, comprising a bottom wall and four side walls extending upwards from the bottom wall, wherein the tops of the four side walls of the shielding housing are correspondingly joined to the bottom of the four side walls of the insulation body so as to jointly form an electronic module receiving space which opens upward, and wherein each of the conductive terminals has a docking part extending into the receiving space, a welded part extending out of the insulation body, and a fixed part fixed onto a side wall of the insulation body.

14 Claims, 12 Drawing Sheets

CAMERA SOCKET CONNECTOR

RELATED APPLICATIONS

This application claims priority to Chinese Application No. 201010218751.2, filed Jun. 30, 2010, which is incorporated herein by reference in its entirety.

FIELD OF THE INVENTION

The present invention relates to an electrical connector, and in particular relates to an electrical connector for housing a camera module.

DESCRIPTION OF THE RELATED ART

With the development of electronic technology, there is a demand to install an increasingly greater number of electrical connectors in order to attach various kinds of electronic modules (such as camera modules having photographic functions) to electronic products such as mobile telephones, personal digital assistants (PDAs), and notebook computers to meet the usage demands of consumers.

Current electrical connectors used to house camera modules, such as the electrical connector disclosed by Chinese patent CN2775870Y, are installed onto a circuit board, the electrical connector comprising an insulation body which has a bottom wall and side walls, a housing space being formed between the bottom wall and side walls; a plurality of signal terminals which are inserted on and combined to on the side walls of the insulation body, and which comprise a contacting part, a connecting part, a fixed part and a welded part; and a shielding housing sheathed outside the insulation body, the contacting part of the signal terminals stretching within the housing space and being crimped so as to be electrically connected to the camera module, and the welded part stretching outside the insulation body along the height of the side walls at any location so as to reach the circuit board and be electrically connected thereto, and the fixed part being securely inserted into a receiving groove of the insulation body. However, such an insertion and combination of the signal terminals necessitates that a plurality of receiving grooves be provided on the side walls of the insulation body to correspondingly receive the fixed parts of the signal terminals, thereby making the structure of the insulation body more complicated and making the manufacture of the corresponding injection mold more difficult and increasing costs. Moreover, providing a plurality of receiving grooves on the insulation body may reduce the structural strength thereof, such that the same may be easily damaged.

Another example is the electrical connector disclosed by Chinese patent CN201112827, which comprises a casing, a pair of insulation bodies assembled on two opposite side walls of the casing, a plurality of conductive terminals fixed by injection molding onto the insulation bodies, and a pair of shielding casings covered by the insulation bodies, the casings and insulation bodies being fixed by means of a strip of a viscous colloid. Although there is no need to provide a plurality of conductive terminal receiving grooves on the insulation bodies of an electrical connector structured in this way, the electrical connector structured in this way comprises the five components of a casing, a pair of insulation bodies and a pair of shielding casings, which components are too numerous such that the machining and assembly steps are cumbersome and complex.

Therefore, further improvement remains to be made for current electrical connectors in order to simplify the product structure thereof and reduce the difficulty and costs of production.

SUMMARY OF THE INVENTION

In an embodiment, an electrical connector for may be used to correspondingly house an electronic module, the electrical connector comprising an insulation body, a plurality of conductive terminals provided on the insulation body, and a shielding housing, wherein the insulation body is a square frame enclosed by four side walls, and the shielding housing is installed beneath the insulation body, comprising a bottom wall and four side walls extending upwards from the bottom wall, wherein the tops of the four side walls of the shielding housing are correspondingly integrated together with the bottom of the four side walls of the insulation body so as to jointly form an electronic module receiving space which opens upward, and wherein each of the conductive terminals comprises a docking part extending into the receiving space, a welded part extending out of the insulation body, and a fixed part fixed onto a side wall of the insulation body.

The bottom of the side walls of the insulation body is provided with a plurality of fixing holes, and the top of the side walls of the shielding housing are provided with a plurality of fixing articles protruding upward, such that the fixing articles are correspondingly inserted into the fixing holes so as to securely connect the shielding housing and the insulation body together.

The fixed parts of the conductive terminals are all securely buried into the side walls of the insulation body by means of insertion molding. In contrast to the prior art, the electrical connector can reduce the number of components and thereby simplify the product structure, because the insulation body equipped with conductive terminals is assembled onto the shielding housing, and because the fixed parts of the conductive terminals are injected using an insertion molding process and buried on the side walls of the insulation body; also, the lack of a need to provide receiving grooves for the conductive terminals on the insulation body can reduce the difficulty and costs of manufacturing the mold.

DETAILED DESCRIPTION OF THE EMBODIMENTS

Figure 1:
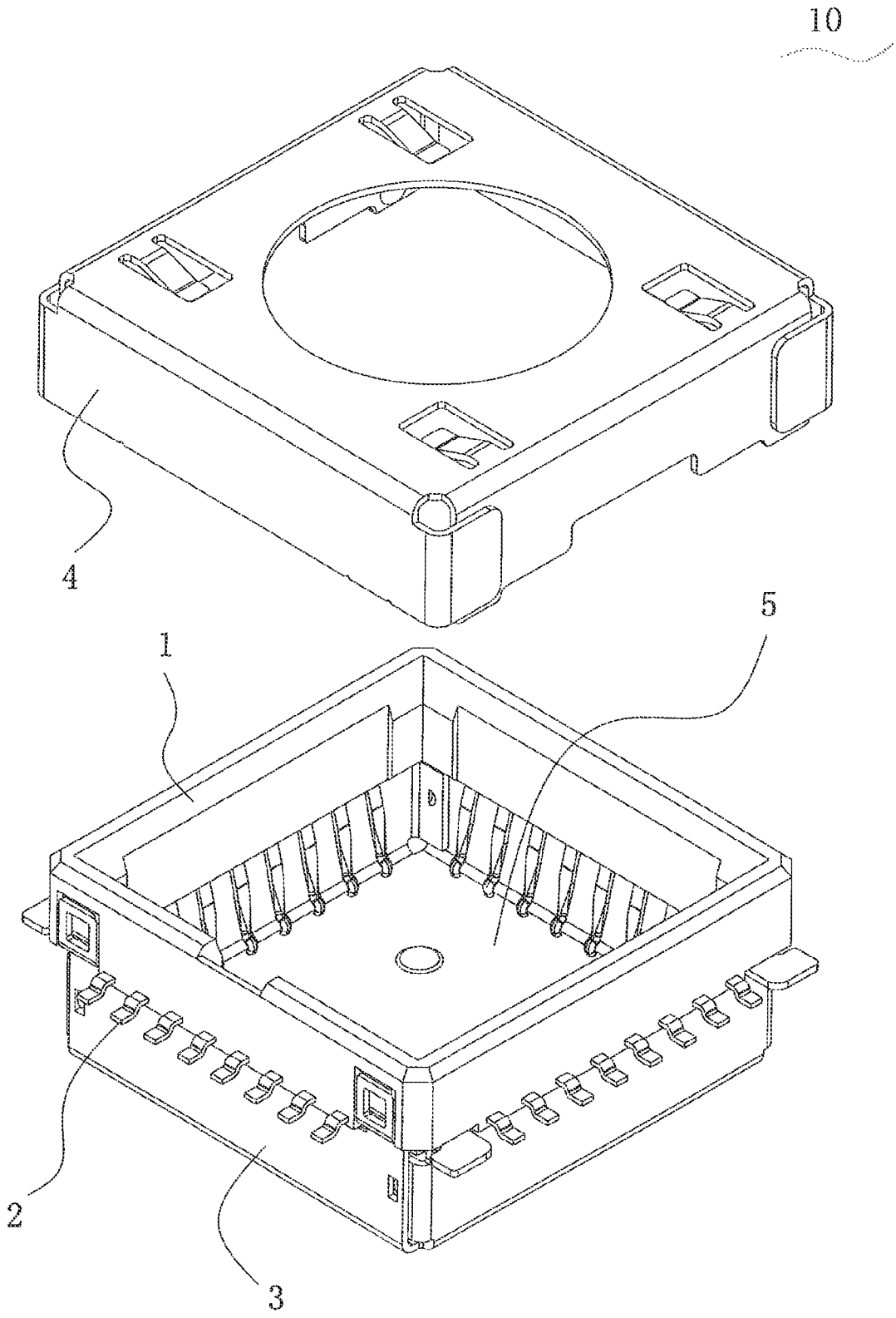
FIG. 1 is a perspective exploded view of an embodiment of the electrical connector.
Figure 2:
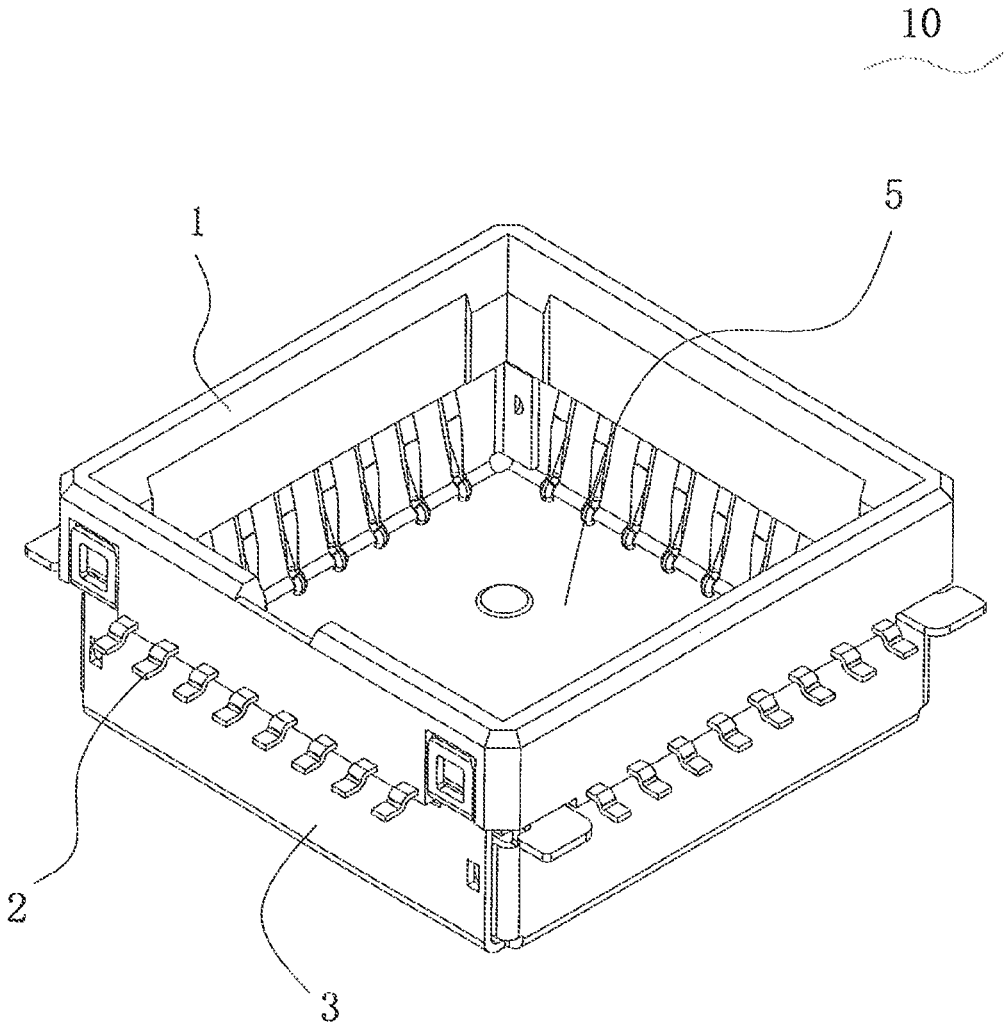
FIG. 2 is a perspective view of the components of the main body of an embodiment of the electrical connector.
Figure 3:
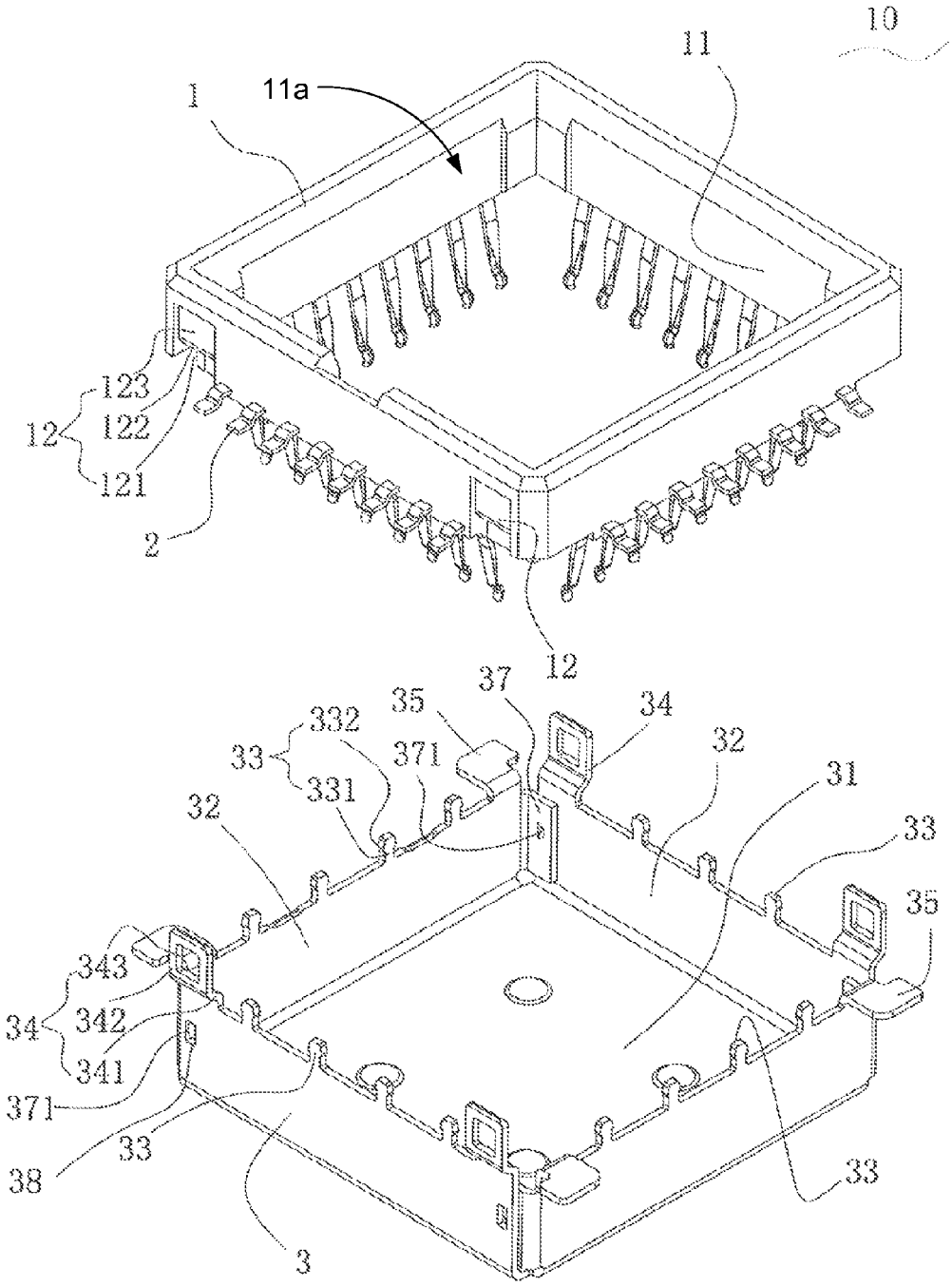
FIG. 3 is a perspective exploded view of the components of the main body of an embodiment of the electrical connector.
Figure 4:
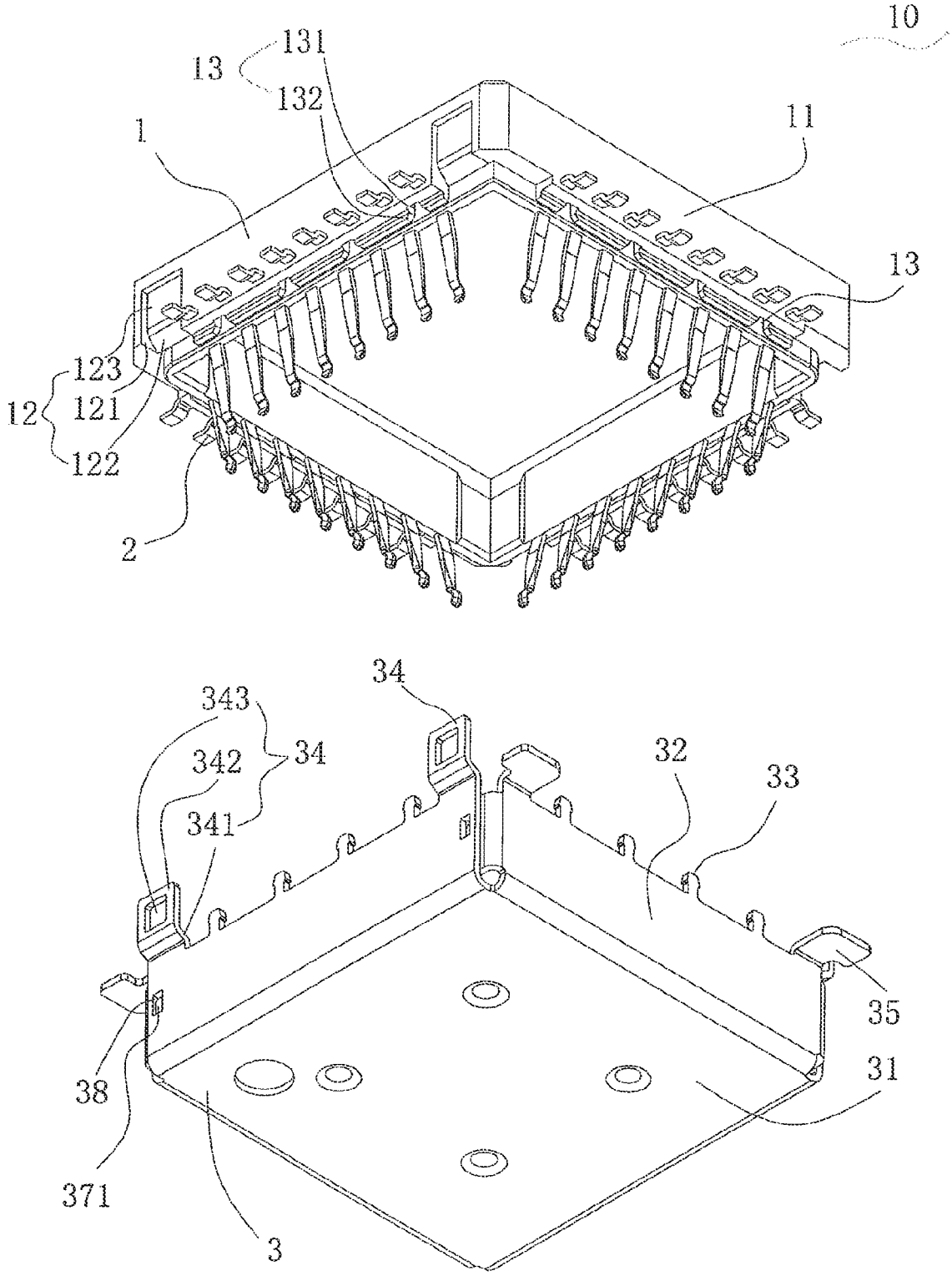
FIG. 4 is a perspective exploded view of another perspective of the components of the main body of an embodiment of the electrical connector.
Figure 5:
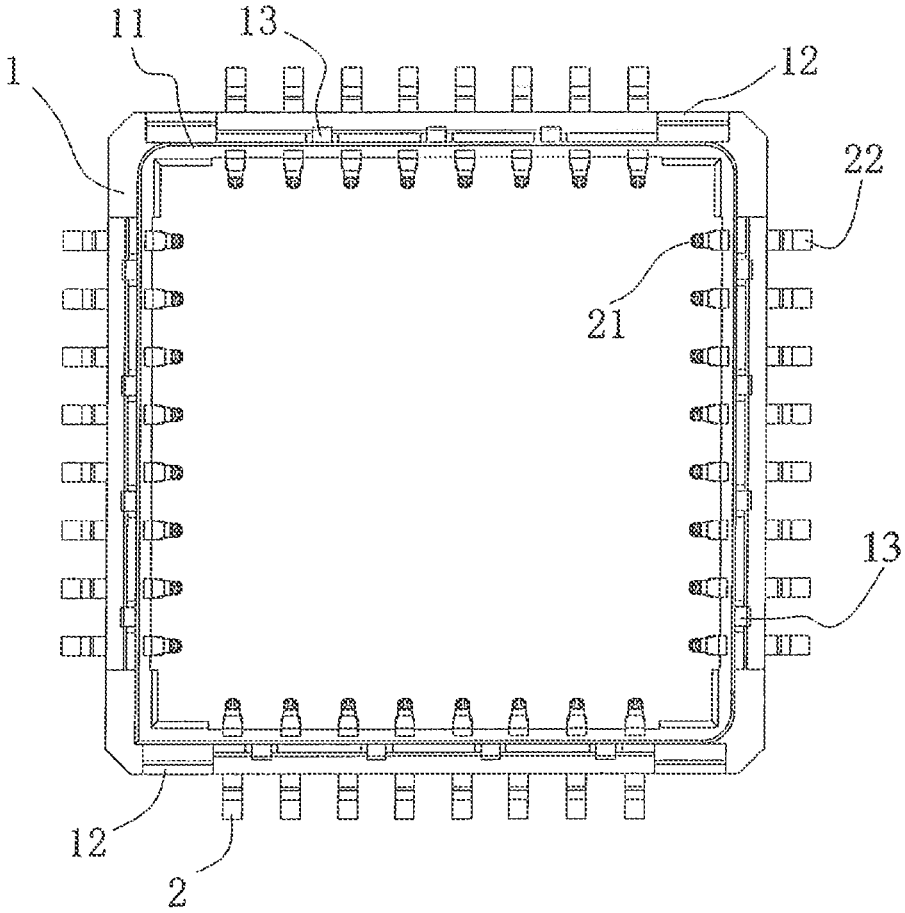
FIG. 5 is a bottom view of the assembly of the insulation body and conductive terminals of an embodiment of the electrical connector.
Figure 6:
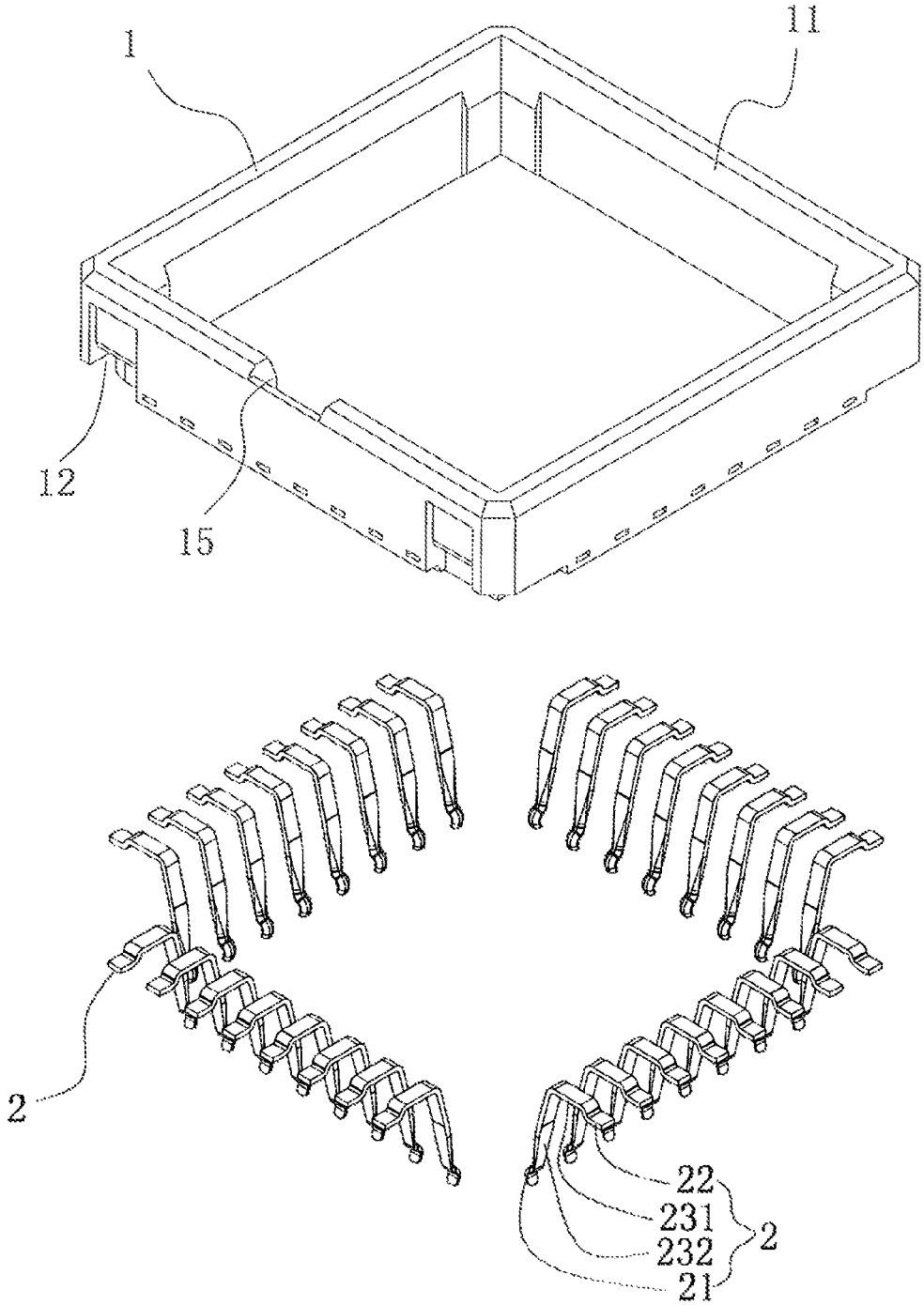
FIG. 6 is a perspective exploded view of the assembly of the insulation body and conductive terminals of an embodiment of the electrical connector, wherein the insulation body and conductive terminals are in a separated state.
Figure 7:
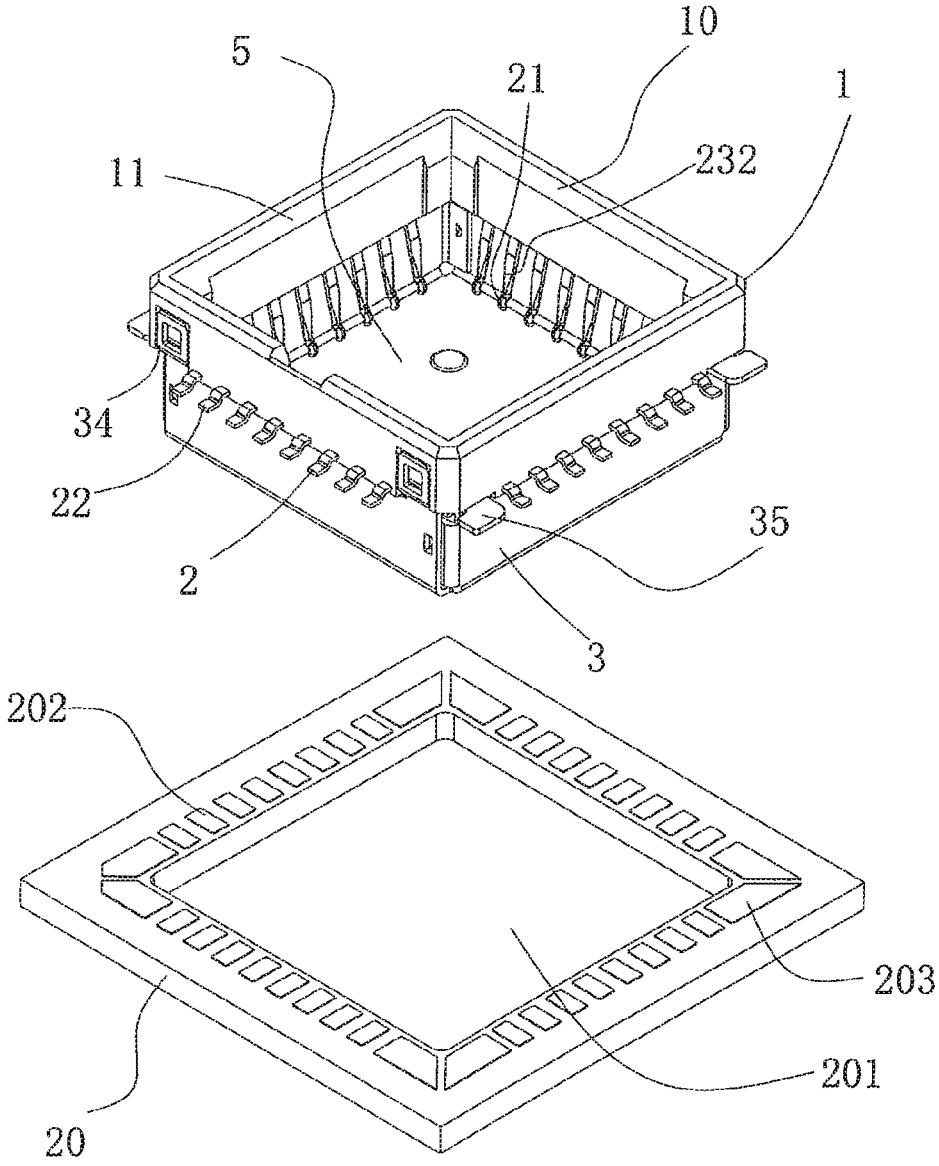
FIG. 7 is a perspective exploded view of the components of the main body of an embodiment of the electrical connector and a circuit board, wherein the components of the main body and the circuit board are in a separated state.
Figure 8:
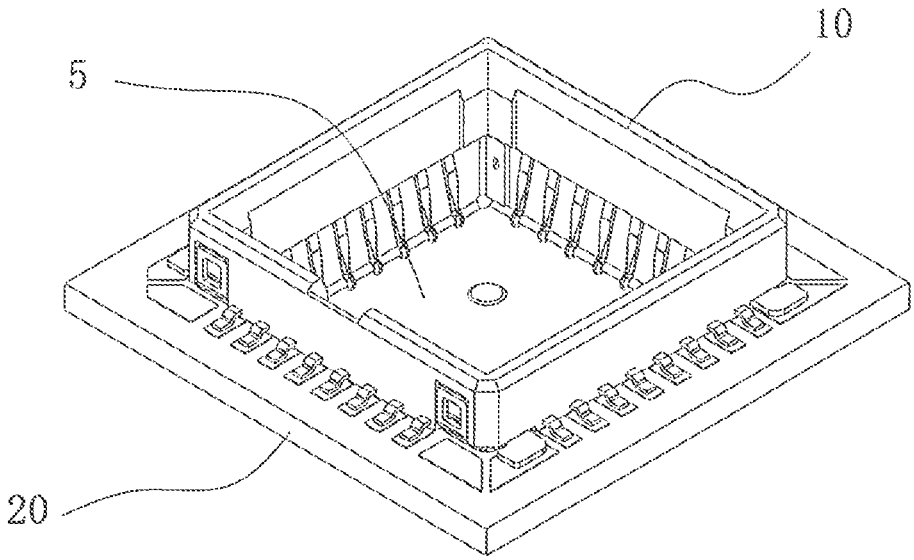
FIG. 8 is a perspective view of the assembly of the components of the main body of an embodiment of the electrical connector and a circuit board.
Figure 9:
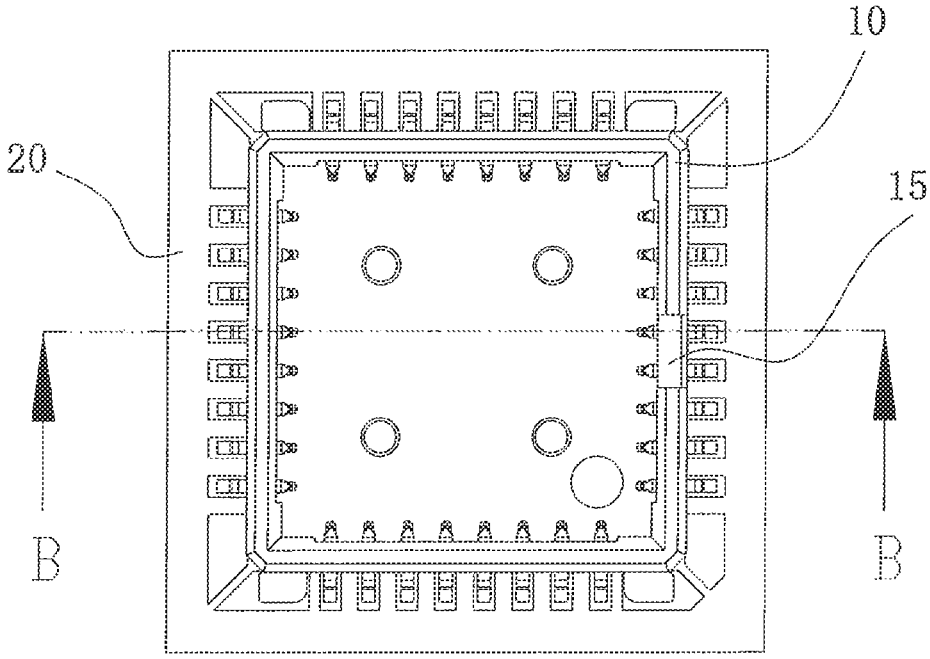
FIG. 9 is a top view of the components of the main body of an embodiment of the electrical connector and a circuit board.
Figure 10:
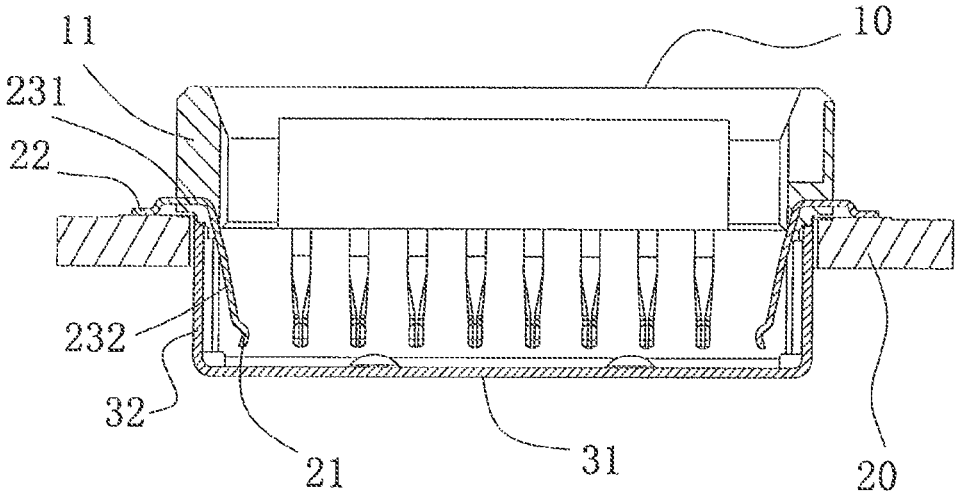
FIG. 10 is a sectional view along the B-B line of FIG. 9.

The following incorporates the drawings to show an example of a connector adapter suitable for connecting a group of camera modules on a mobile phone, so as to provide a more detailed description. The technical problems which the disclosure can help address are the above insufficiencies found in the prior art, and to provide an electrical connector wherein the product structure can be simplified and at the same time reducing the difficulty and costs of production.

FIGS. 1 to 6 show the components of the main body of an embodiment of electrical connector 10, comprising insulation body 1, a plurality of conductive terminals 2 installed on insulation body 1, and shielding housing 3 installed beneath insulation body 1. In addition to the above components of the main body, an embodiment of electrical connector 10 may further comprise cover 4, which can cover the upper exterior of insulation body 1.

FIGS. 3 to 6 are incorporated below to further describe the structure of the components of the main body of an embodiment of electrical connector 10. Insulation body 1 is formed by integrally injecting a molten plastic material, and enclosed by four side walls 11 so as to form a square frame that includes an inside area 11*a* provided between the four side walls 11. Insulation body 1 is provided with four slots 12 on the exterior of both ends of two opposite side walls 11, and the bottom of four side walls 11 is provided with a plurality of fixing holes 13, wherein a positioning groove 15 is formed on the interior of one side wall 11. Each slot 12 comprises a groove part 121 provided as a concavity on the exterior of both ends of side wall 11 and correspondingly formed so as to open on side wall 11, curved surface 122 formed within groove part 121 and extending up out of the bottom of side wall 11, and flat surface 123 continuously extending up from the top of curved surface 122. Each fixing hole 13 comprises a hole part 131 provided on side wall 11 and opening 132 correspondingly formed under hole part 131, wherein opening 132 is flared so as to be largest at the bottom-most opening and to gradually reduce in size upward.

Each conductive terminal 2 has an overall L-shape and comprises docking part 21 extending out at a downward incline, welded part 22 extending horizontally outward, fixed part 231 provided at the bending transition point between docking part 21 and welded part 22, and elastic part 232 at one end of docking part 21 and extending at a slight downward tilt. The docking surface of docking part 21 is a closed-out space inclined slightly upward toward four side walls 11 of insulation body 1. Fixed parts 231 of conductive terminals 2 are buried by being injected with an insert molding process so as to be fixed into side walls 11 of insulation body 1; specifically, conductive terminals 2 are clamped onto an injection mold (not shown in the drawings), and then implanted into the molten plastic material in the mold, and the molten plastic material is molded by cooling so as to then form insulation body 1, fixed parts 231 of conductive terminals 2 being covered therein.

Figure 11:
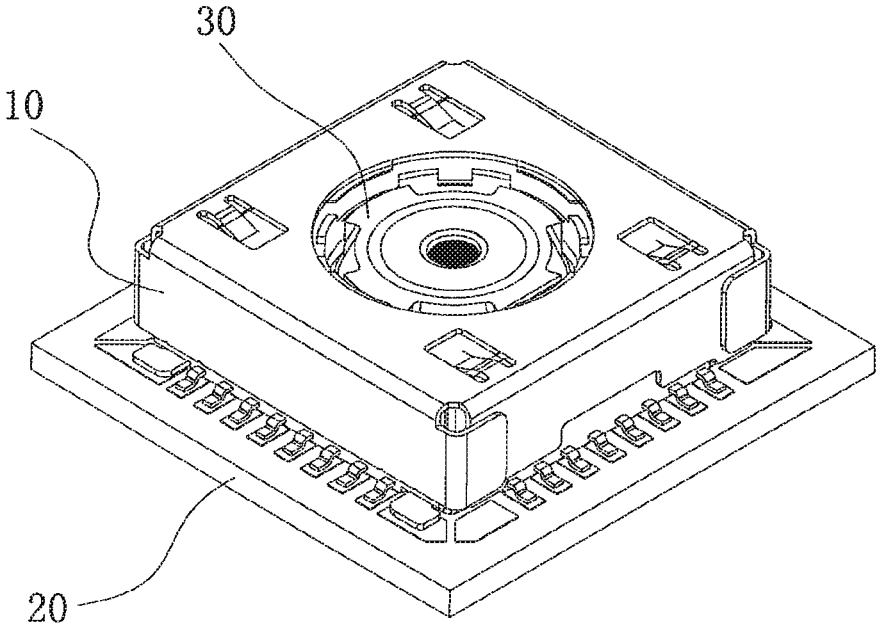
FIG. 11 is a perspective view of the assembly of an embodiment of the electrical connector with a circuit board and a camera module.

Shielding housing 3 is formed by integrally punching and bending a metal material, and shielding housing 3 comprises bottom wall 31 and four side walls 32 bent to extend upward from the edges of bottom wall 31, the top of four side walls 32 being correspondingly joined to the bottom of four side walls 11 of insulation body 1. A plurality of fixing articles 33 are projected upward out from the top part of four side walls 32, wherein four locking pieces 34 are projected up out at both ends of the tops of a first pair of opposite side walls 32, and four grounding pieces 35 are extended bending outward at both ends of the tops of a second pair of opposite side walls 32. Two bindings 37 are extended out bent at both ends of the second pair of opposite side walls 32 in toward the first pair of opposite side walls 32, at least one stud 371 being provided thereon, and two openings 38 which are mated to studs 371 are arranged at both ends of the first pair of opposite side walls 32. Each fixing article 33 comprises a base part 331 and two fastening parts 332 protruding outward from both sides of base part 331, wherein two fastening parts 332 are inserted into fixing holes 13 so as to form an interference fit therewith, thereby making it difficult for shielding housing 3 to be released downward. Each locking piece 342 comprises bent part 341 linked to side wall 32, a locking part 342 extending up out of bent part 341 and locking hole 343 arranged on locking part 342. Mating fixing articles 33 to fixing holes 13 on the bottom of four side walls 11 of insulation body 1 fixes shielding housing 3 beneath insulation body 1, thereby forming, together with insulation body 1, receiving space 5 which is able to hold camera module 30 (see FIG. 11). Locking pieces 34 can be correspondingly housed in slots 12 of insulation body 1, wherein bent parts 341 of locking pieces 34 are mated to bent surfaces 122 of slots 12 and locking parts 342 of locking pieces 34 are mated to flat surfaces 123 of slots 12.

Figure 12:
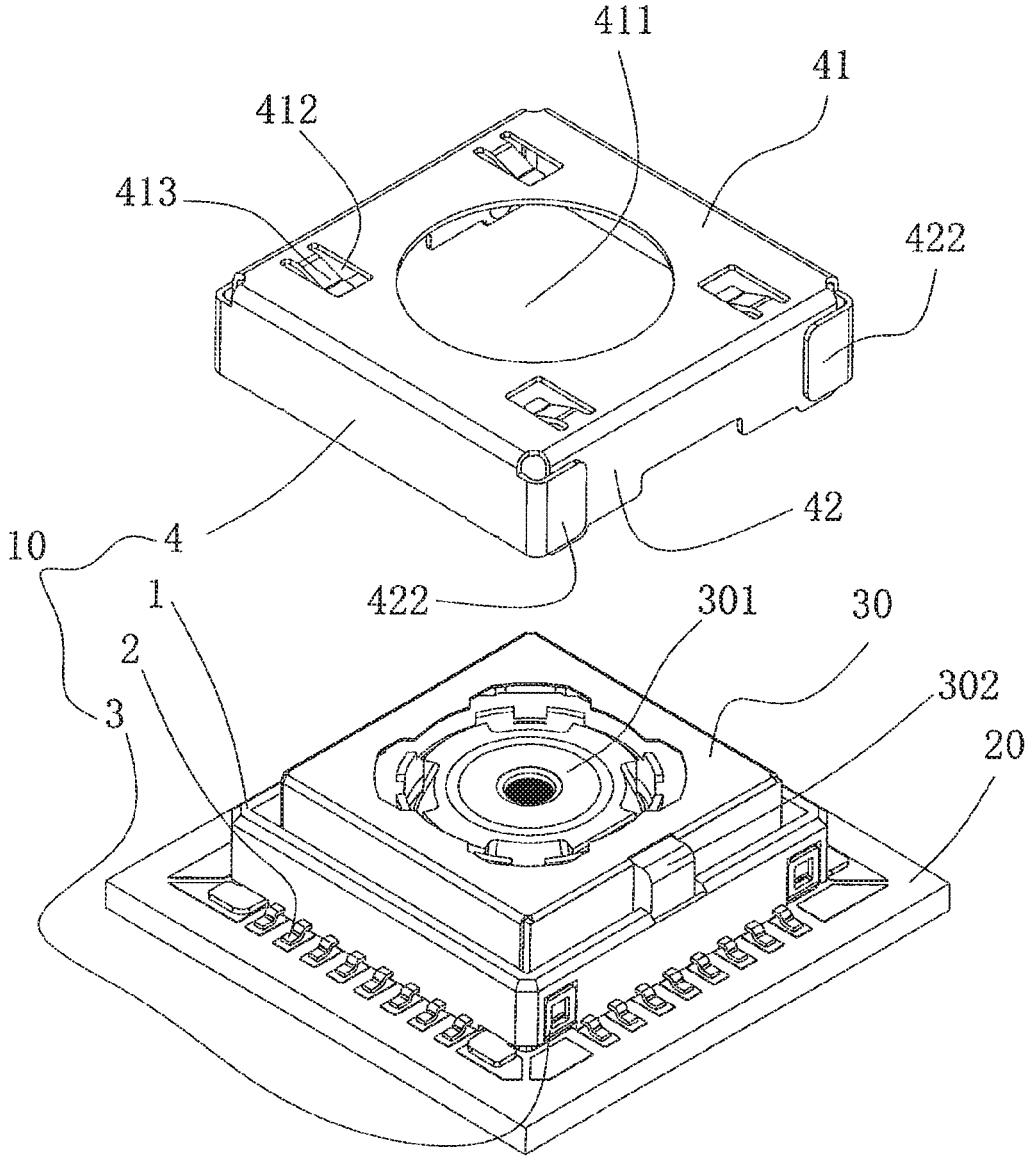
FIG. 12 is a perspective exploded view of the assembly an embodiment of the electrical connector with a circuit board and a camera module, wherein the components of the main body and the cover are in a separated state.
Figure 13:
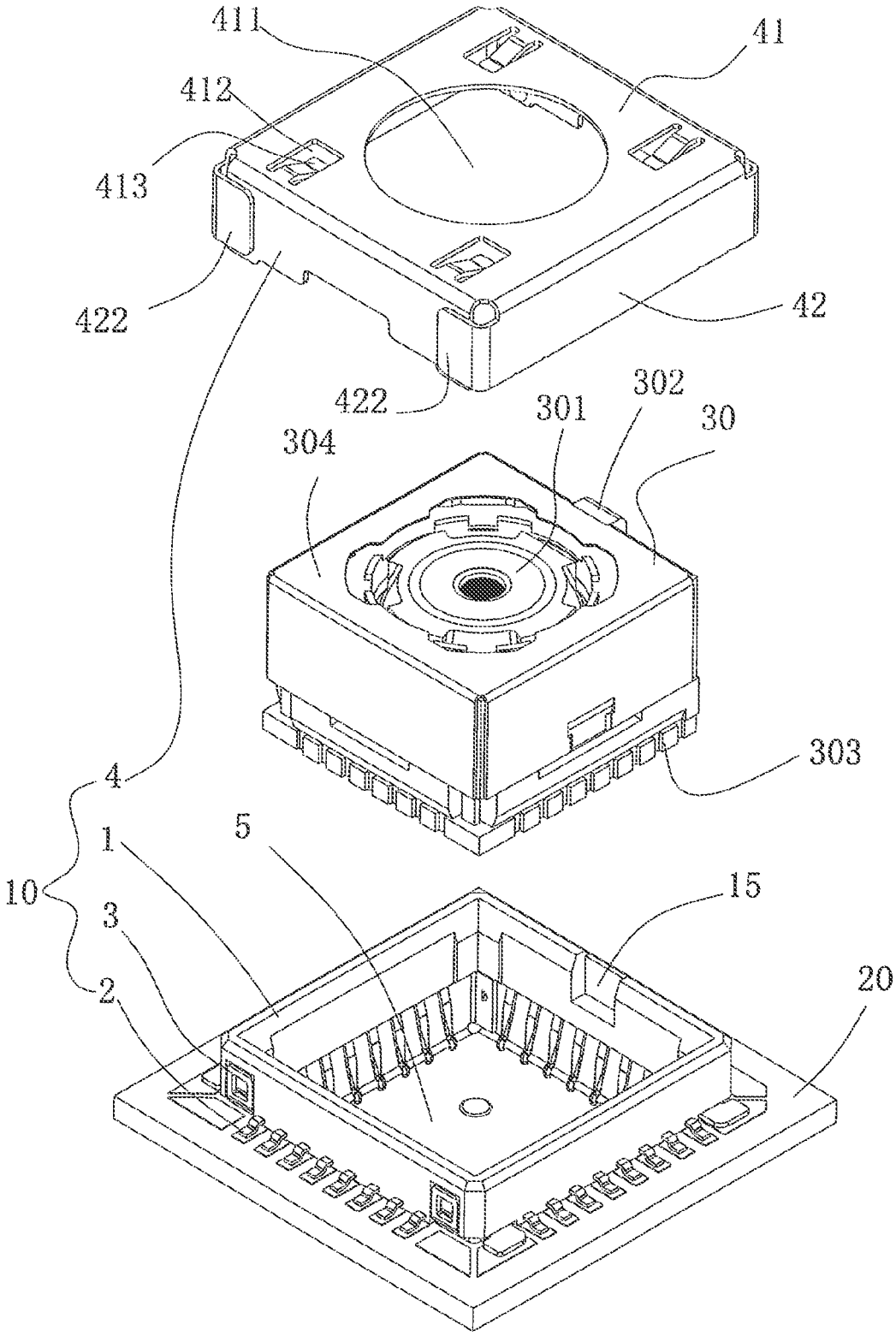
FIG. 13 is a perspective exploded view of the assembly of an embodiment of the electrical connector with a circuit board and a camera module, wherein the components of the main body, camera module and cover are all in a separated state.
Figure 14:
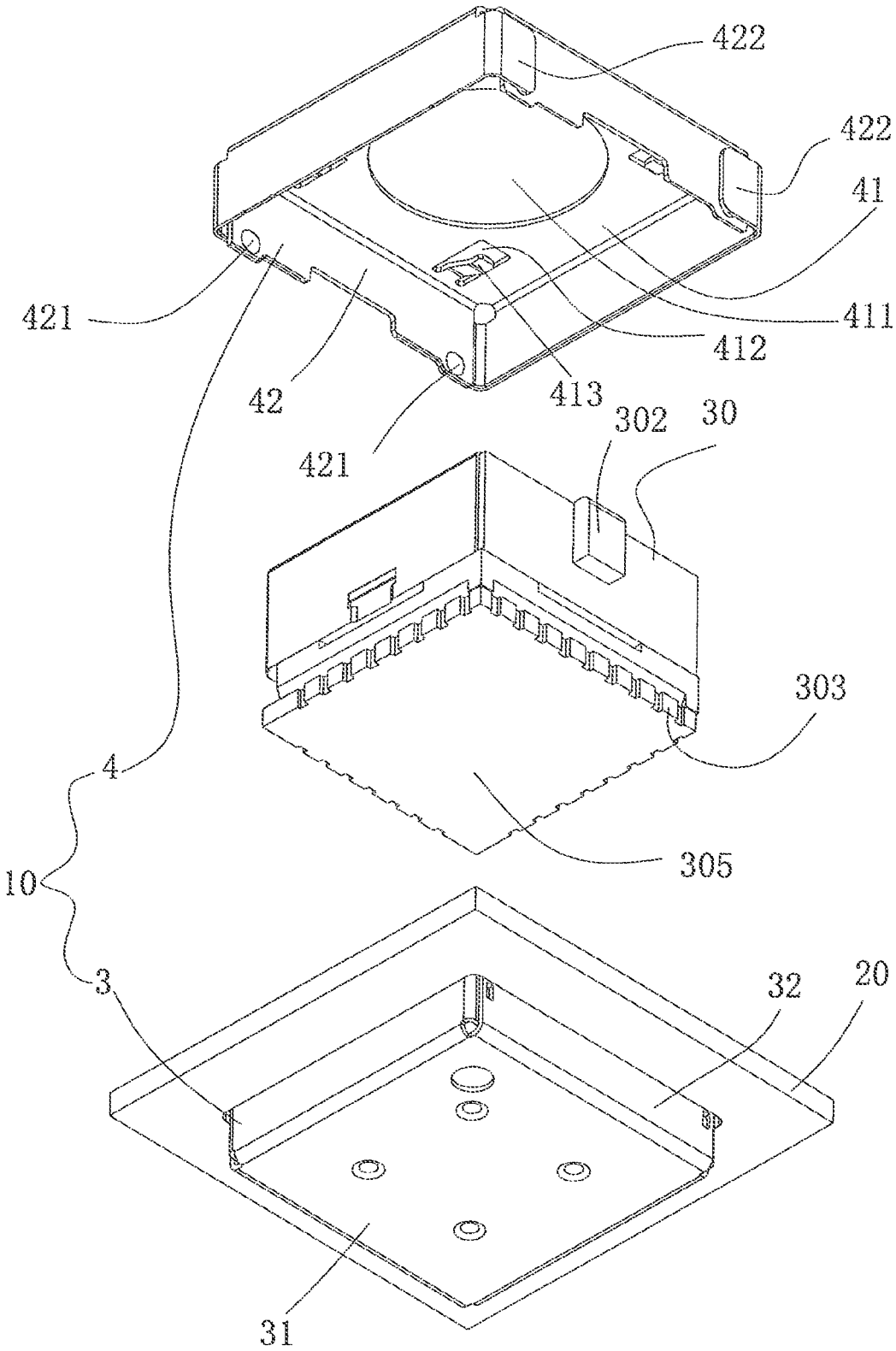
FIG. 14 is a perspective exploded view of the assembly of an embodiment of the electrical connector with a circuit board and a camera module from another perspective, wherein the components of the main body, camera module and cover are all in a separated state.

FIGS. 12 to 14 describe the structure of cover 4 of an embodiment of electrical connector 10. Cover 4 is formed by integrally punching and bending a metal material, and cover 4 comprises top wall 41 and four side walls 42 extending downward from the edges of top wall 41. The top of top wall 41 is provided with a hole 411, four openings 412 located on the four sides of hole 411 and elastic arms 413 projecting downward at openings 412. Four locking parts 421 are formed projecting inward at both ends of the interior of a first pair of opposite side walls 42, and four bindings 422 are formed at both ends of a second pair of opposite side walls 42 and bent to project toward the exterior of the first pair of opposite side walls 42. Herein, four bindings 422 opposite from the first pair of opposite side walls 42 can be active. Four locking parts 421 can be mated to locking holes 343 on locking pieces 34 of shielding housing 3 so as to abut one another, thereby fixing cover 4 onto the components of the main body. At the same time, cover 4 can be grounded by means of locking pieces 34 and grounding pieces 35 of shielding housing 3 so as to form a shielding structure together with shielding housing 3, thereby achieving the objective of shielding from electromagnetic interference.

Referring to FIGS. 7 to 10 regarding the assembly of the components of the main body of an embodiment of electrical connector 10. Circuit board 20 is provided with hole 201 mated to shielding housing 3, a plurality of welded plates 202 mated to conductive terminals 2, and four welded plates 203 mated to grounding pieces 35 on shielding housing 3. It can be seen in FIG. 10 that the size of the external contour of shielding housing 3 is smaller than the size of the external contour of insulation body 1, such that the upper and lower composite design of shielding housing 3 and insulation body 1 makes it easier for shielding housing 3 to sink down into hole 201 of circuit board 20 and be maintained at a size smaller than the profile of insulation body 1, which is advantageous for miniaturizing the product.

Referring to FIGS. 11 to 14 regarding an embodiment of an assembly of electrical connector 10 with circuit board 20 and camera module 30. Camera module 30 comprises lens 301, positioning block 302 formed on the side thereof, and a plurality of conductive sheets 303 formed at the bottom side, and camera module 30 is provided with top surface 304 and bottom surface 305. The assembly thereof is to plug camera module 30 into receiving space 5 formed by insulation body 1 and shielding housing 3 of electrical connector 10 and then mating positioning block 302 on camera module 30 to positioning groove on insulating body 1 and mating conductive sheet 303 to docking part 21 of conductive terminal 2. Also, elastic arm 413 of cover 4 presses onto top surface 304 of camera module 30 so as to elastically clamp camera module 30 into electrical connector 10 to achieve an electrical connection through conductive sheet 303 and conductive terminals 2 with circuit board 20. By designing conductive terminals 2 to be contacting surfaces of docking parts 21 facing receiving space 5, it is possible to contact the same from the side with conductive sheet 303 on camera module 30, thereby taking full advantage of receiving space 5 to lower the height of electrical connector 10, which is advantageous for miniaturizing the product.

The process for manufacturing and assembling electrical connector 10 can include the following steps. Conductive terminals 2, shielding housing 3 and cover 4 are formed by punching and bending, and insulation body 1 is formed by injection-molding on the exterior of conductive terminals 2 using an insertion molding process, fixed parts 231 of conductive terminals 2 being covered therein; the top of shielding housing 3 is then correspondingly plugged in so as to be fixed to the bottom of insulation body 1 to assemble the components of the main body of electrical connector 10. When electrical connector 10 is put into practice, the components of the main body can be first welded onto circuit board 20, and then camera module 30 is installed in receiving space 5 of the components of the main body. Finally cover 4 is assembled above insulation body 1.

In contrast to the prior art, electrical connector 10 can be installed onto shielding housing 3 by means of insulation body 10, which is provided with conductive terminals 2, thereby enabling a reduction in the number of components and simplification of the assembly steps thereof. The effect of a fixed connection is achieved by correspondingly plugging fixing articles 33 of the top of shielding housing 3 into fixing holes 13 of the bottom of insulation body 1, and such a mode of fixation is easy to install and can obtain a more favorable fixation effect. By injecting fixed parts 231 of conductive terminals 2 using an insertion molding process so as to be securely buried into four side walls 11 of insulation body 1, the need is obviated to arrange a conductive terminal receiving groove of comparatively greater height on the insulation body as in the prior art, thereby making it possible to simplify the injection molding structure and reduce molding costs, while also helping to lower the height of insulation body 1; the fixed installation and grounding process of cover 4 can be facilitated by mating locking parts 421 of cover 4 to locking holes 343 of shielding housing 3.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

The invention claimed is:

1. An electrical connector suitable for housing an electronic module, the electrical connector comprising:

an insulation body, wherein the insulation body has a square frame formed by four side walls;

a plurality of conductive terminals provided on the insulation body; and a shielding housing, the shielding housing is installed beneath the insulation body and comprises a bottom wall and four side walls extending up out from the bottom wall, the bottom wall being positioned below the insulation body, the tops of the four side walls of the shielding housing being correspondingly joined to the bottoms of the four side walls of the insulation body so as to jointly form an electronic module receiving space which opens upward, and wherein each of the conductive terminals comprises a docking part extending into the receiving space, a welded part extending out of the insulation body, and a fixed part fixed onto a side wall of the insulation body, wherein the welded part is positioned above the bottom wall and the docking part extends toward the bottom wall.

2. The electrical connector according to claim 1, wherein a plurality of fixing holes are provided on the bottom of the side walls of the insulation body and a plurality of fixing articles are provided protruding upward from the tops of the side walls of the shielding housing, the fixing articles being correspondingly plugged into the fixing holes so as to securely integrate the shielding housing and insulation body.

3. The electrical connector according to claim 2, wherein the fixing articles on the shielding housing project upward from the tops of the side walls and each fixing article comprises a base and two fastening parts projecting outward from the base.

4. The electrical connector according to claim 1, wherein a plurality of slots are provided on the exterior of the side walls of the insulation body and a plurality of locking pieces are provided extending upward from the side walls of the shielding housing, the locking pieces being correspondingly housed in the slots.

5. The electrical connector according to claim 4, wherein each of the locking pieces comprises a bent part connected to the side walls of the shielding housing, a locking part projecting upward from the bent part, and a locking hole arranged on the locking part.

6. The electrical connector according to claim 4, wherein the electrical connector further comprises a cover, and the cover comprises a top wall and four side walls extending downward from the top wall, a plurality of locking parts projecting inward from the side walls of the cover, the locking parts being correspondingly mated to the locking pieces on the shielding housing so as to integrally connect the cover with the shielding housing.

7. The electrical connector according to claim 6, wherein the cover and the shielding housing are both manufactured from a metal material, and a plurality of grounding pieces are arranged on the shielding housing, the cover being electrically connected onto the shielding housing by means of the locking parts, wherein grounding is achieved by means of the grounding pieces of the shielding housing.

8. The electrical connector according to claim 6, wherein a hole is arranged on the top wall of the cover and four elastic arms projecting downward are provided on the four sides of the hole.

9. The electrical connector according to claim 1, wherein the fixed parts of the conductive terminals are all insert molded into the side walls of the insulation body.

10. The electrical connector according to claim 9, wherein two bindings are provided on the shielding housing bent to extend out from both ends of two side walls each in the direction of the other two side walls, each binding being provided with at least one stud and at least one hole being provided on each of the other two side walls of the shielding housing such that the holes and the studs are correspondingly mated so as to integrally connect the four side walls of the shielding housing.

11. The electrical connector according to claim 9, wherein the size of the outer profile of the shielding housing is smaller than the size of the outer profile of the insulation body.

12. The electrical connector according to claim 9, wherein each conductive terminal essentially has an L-shape, wherein the docking part extends out at a downward incline and the welded parts extend out on a flat plane such that the fixed parts are provided at the bending transition point between the docking parts and welded parts.

13. An electrical connector, comprising:

an insulation body, the insulation body having four side walls that define a frame, the frame defining an inside area that extends between the four side walls, the inside area being open;

a plurality of conductive terminals supported by the insulation body, the terminals including a docking part extending into the inside area and a welded part extending into an area outside of the frame; and a shielding housing, the shielding housing is installed beneath the insulation body and comprises a bottom wall and four side walls extending up out from the bottom wall, the bottom wall being positioned below the insulation body, wherein the insulation body is position on top of the four side walls of the shielding housing so as to jointly form an electronic module receiving space which opens upward, wherein each of the conductive terminals comprises a docking part extending below the insulation body toward the bottom wall and the welded part is positioned above the bottom wall.

14. The electrical connector of claim 13, wherein the plurality of conductive terminals are insert-molded into the insulation body.

* * * * *